US008109434B2

(12) United States Patent
Kim

(10) Patent No.: US 8,109,434 B2
(45) Date of Patent: Feb. 7, 2012

(54) CASH TRANSACTION MACHINE

(75) Inventor: Youn Jong Kim, Gyeonggi-do (KR)

(73) Assignee: Nautilus Hyosung Inc., Seoul (KR)

( * ) Notice: Subject to any disclaimer, the term of this patent is extended or adjusted under 35 U.S.C. 154(b) by 896 days.

(21) Appl. No.: 11/967,431

(22) Filed: Dec. 31, 2007

(65) Prior Publication Data

US 2009/0121011 A1 May 14, 2009

(30) Foreign Application Priority Data

Nov. 8, 2007 (KR) ..... 10-2007-0113938

(51) Int. Cl.
*A45C 1/12* (2006.01)

(52) U.S. Cl. ..... 232/1 D; 232/15; 194/350; 109/45; 902/9

(58) Field of Classification Search ..... 232/1 D, 232/43.2, 12, 15, 16, 44; 235/379; 902/9; 194/350, 206; 109/45, 47, 50, 52, 58, 64
See application file for complete search history.

(56) References Cited

U.S. PATENT DOCUMENTS

| | | | | |
|---|---|---|---|---|
| 3,083,896 | A * | 4/1963 | Cairelli et al. | 232/15 |
| 4,649,832 | A * | 3/1987 | Hain et al. | 109/24.1 |
| 5,896,974 | A * | 4/1999 | Chang | 194/206 |
| 6,082,519 | A * | 7/2000 | Martin et al. | 194/350 |
| 7,413,118 | B2 * | 8/2008 | Kim | 235/379 |
| 2004/0178564 | A1 * | 9/2004 | Graef et al. | 271/162 |
| 2009/0056599 | A1 * | 3/2009 | Turner et al. | 109/2 |

FOREIGN PATENT DOCUMENTS

| | | | |
|---|---|---|---|
| JP | 11031253 | A | 2/1999 |
| KR | 20-03085086 | | 5/2005 |
| KR | 100607562 | A | 7/2006 |
| KR | 1020070070586 | A | 7/2007 |

* cited by examiner

*Primary Examiner* — William L. Miller

(74) *Attorney, Agent, or Firm* — Fish & Richardson P.C.

(57) ABSTRACT

A side open-and-close type cash transaction machine is provided. A cash transaction machine includes: a body including an opening on a side of the body; a door being mounted on the body to open and close the opening; a first financial module being integrally formed with the door in the door to be externally exposed when the door is opened; and a second financial module being provided in the body, separate from the door to move toward the opening when the door is opened. Since the second financial module may be provided and be exposed separate from the first financial module, it is possible to easily manage the financial modules and also reduce the size of the side open-and-close type cash transaction machine.

9 Claims, 9 Drawing Sheets

CASH TRANSACTION MACHINE

CROSS-REFERENCE TO RELATED APPLICATION

This application claims priority from Korean Patent Application No. 10-2007-0113938, filed on Nov. 8, 2007, in the Korean Intellectual Property Office, the entire disclosure of which is incorporated herein by reference.

BACKGROUND OF THE INVENTION

1. Field of the Invention

The present invention relates to a cash transaction machine, and more particularly, to a cash transaction machine that includes a door on a side of the cash transaction machine.

2. Description of Related Art

Generally, a cash transaction machine can be installed in a financial institution such as a bank in order to provide convenient financial services for banking customers. Also, the cash transaction machine may be installed in a convenient store, a public place, and the like. Therefore, banking customers may readily deposit and withdraw money using the cash transaction machine. Also, the banking customers may use various types of financial services such as checking of the balance, a transfer service, and the like.

The cash transaction machine includes various types of modules, such as a dispensing module, a depositing module, a card reader, a bankbook arrangement module, a main controller, and the like. The independently installed modules may be electrically connected to the main controller and perform cooperative functions.

A door is provided to open and provide access to the inside of the cash transaction machine. Generally, the door is provided on a front surface or a rear surface of the cash transaction machine. However, when sufficient space is not provided in the front and the rear of the cash transaction machine, the door needs to be provided on a side of the cash transaction machine. The cash transaction machine that includes the door on the side of the cash transaction machine may be referred to as a side open-and-close type cash transaction machine.

In a conventional side open-and-close type cash transaction machine, the dispensing module and the depositing module are integrally formed with the door. In this case, when the door is opened, both the dispensing module and the depositing module may be simultaneously exposed. Specifically, the conventional side open-and-close type cash transaction machine includes the dispensing module that is disposed inside the door and the depositing module that is disposed inside the dispensing module. Therefore, both the dispensing module and the depositing module are provided in the door. When the door is opened, both modules are turned together with the door and are externally exposed. Conversely, when the door is closed, both the modules move into the cash transaction machine to designated internal mounting locations.

Since the dispensing module and the depositing module are attached to the door, various types of problems may occur. For example, since the dispensing module and the depositing module are attached to the door, disadvantages may occur in maintenance and repair. When the dispensing module needs to be repaired and maintained, the depositing module that is attached to the dispensing module must be separated from the dispensing module. Also, since the dispensing module and the depositing module are attached together, the width of the door must be larger than the size of the dispensing module or the size of the depositing module in order to open the door while preventing the depositing module from becoming caught on the door. Therefore, it may be difficult to reduce the front and rear length of the cash transaction machine. Also, the weight of the dispensing module and the depositing module may damage a hinge of the door. When the door is opened, the dispensing module and the depositing module may deviate from the centroid. In this case, the weight distribution may be unbalanced in the cash transaction machine.

SUMMARY OF THE INVENTION

An aspect of the present invention provides a cash transaction machine that can independently include a plurality of modules and thus can effectively manage each of the modules.

Another aspect of the present invention also provides a cash transaction machine that does not need an increase in the size and length of the front and rear of the cash transaction machine, and that can be manufactured within a predetermined size.

According to an aspect of the present invention, there is provided a cash transaction machine including: a body including an opening on a side of the body; a door being mounted on the body to open and close the opening; a first financial module being integrally formed with the door in the door to be externally exposed when the door is opened; and a second financial module being provided in the body, separate from the door to move toward the opening when the door is opened.

In an aspect of the present invention, the body may be referred as a type of housing that receives a plurality of modules in the cash transaction machine. The opening may be formed on the side of the body and may be opened and closed by the door. The plurality of financial modules may be disposed in the body. The financial modules may include a dispensing module, a depositing module, a main controller, a card reader, a bankbook arrangement module, and the like. Specifically, the financial modules may be independently provided in the cash transaction machine.

The first financial module is disposed on the inner surface of the door. Therefore, when the door is opened, the first financial module may be externally exposed together with the door. However, the second financial module is provided in the body, separate from the door. Also, the second financial module may move toward an outside, that is, the opening, depending on the necessity of an operator. Therefore, the operator does not need to separate the second financial module in order to repair or maintain the first financial module. Since a side surface of the first financial module is directly exposed, the first financial module may be more variously designed. Also, when the door is opened, only the first financial module is exposed and thus it is possible to reduce the load to the door. The operator may easily open and close the door.

When the door is opened, the first financial module is also externally exposed. However, a separate operation is needed to take out the second financial module from the cash transaction machine. Generally, the operator may directly move the second financial module to the outside using a knob formed on the second financial module. Depending on embodiments, it is possible to construct the second financial module to automatically move. The second financial module may move toward the outside by a predetermined guide member. Also, the second financial module may be slidable with respect to the guide member and thereby additionally move to the outside.

BRIEF DESCRIPTION OF THE DRAWINGS

The above and other aspects of the present invention will become apparent and more readily appreciated from the following detailed description of certain exemplary embodiments of the invention, taken in conjunction with the accompanying drawings of which.

DETAILED DESCRIPTION OF EXEMPLARY EMBODIMENTS

Figure 1:
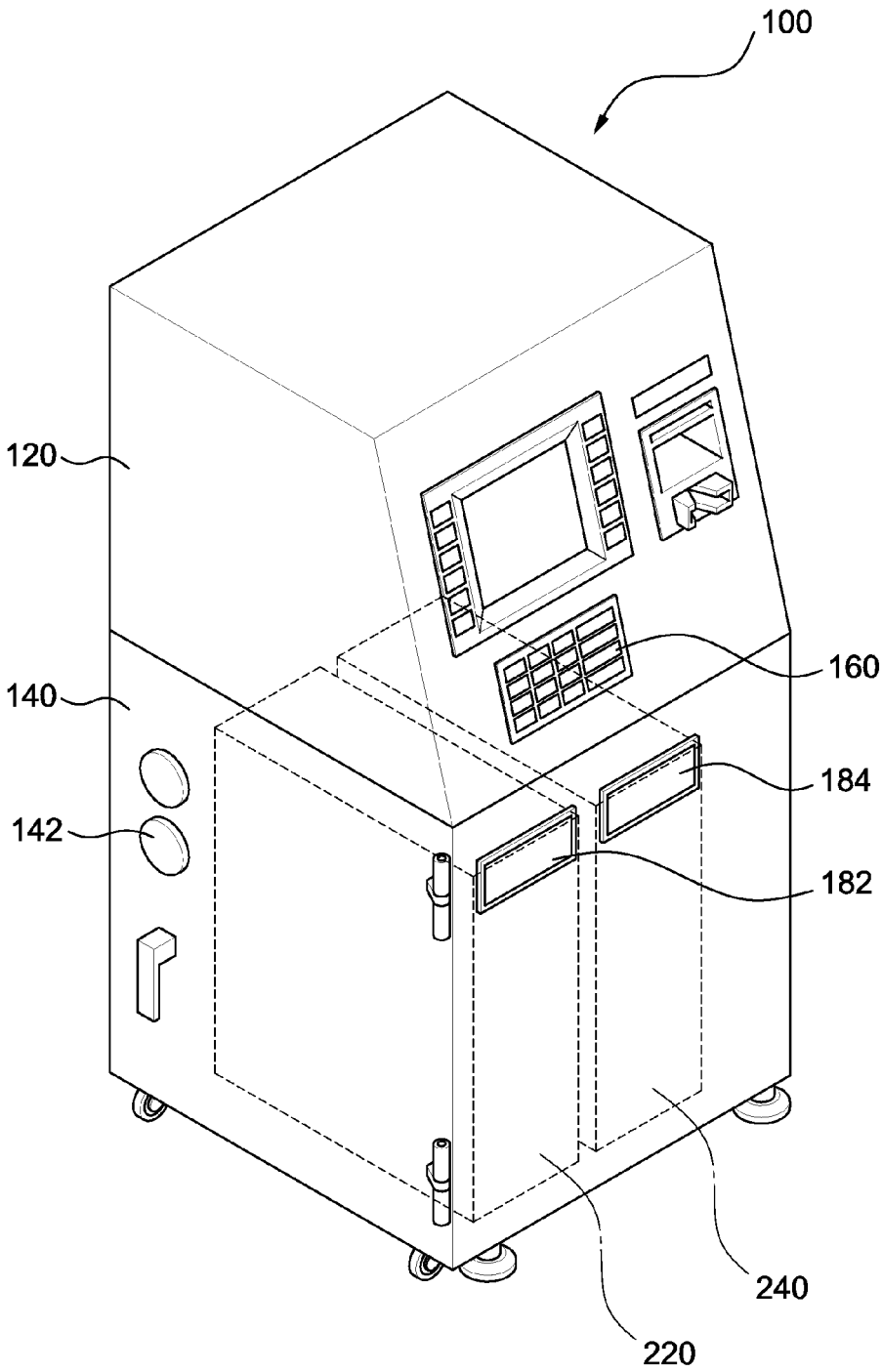
FIG. 1 is a perspective view illustrating a cash transaction machine according to an exemplary embodiment of the present invention.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

Figure 2:
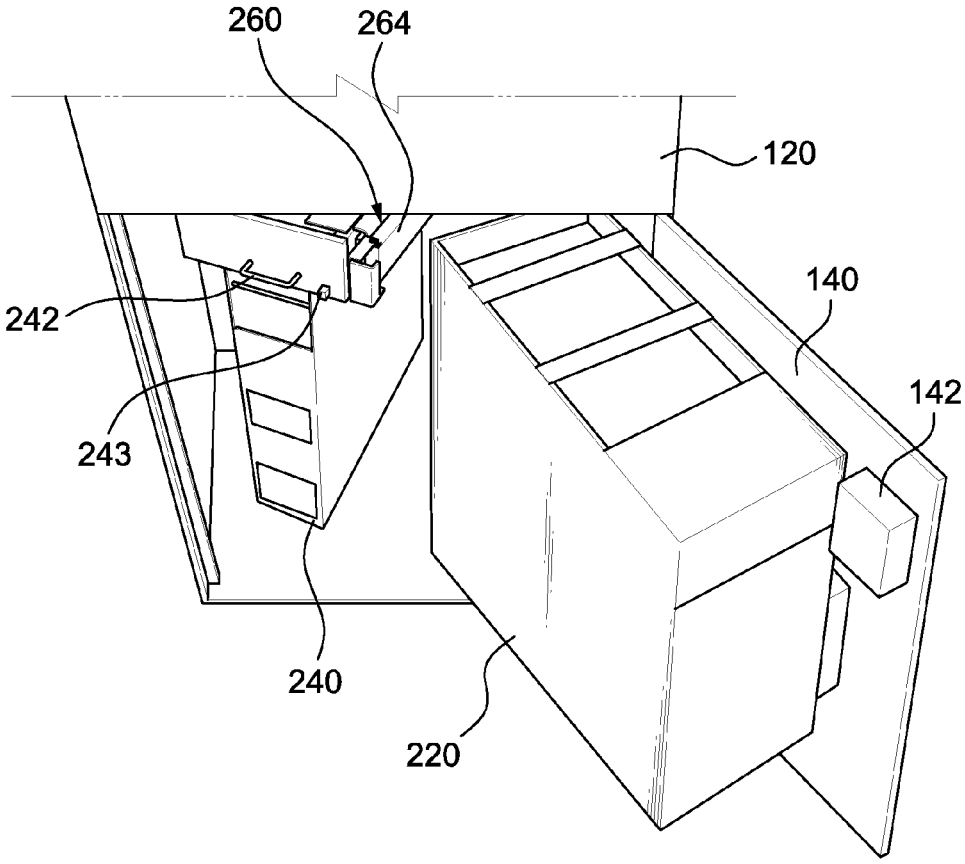
FIG. 2 is a perspective view illustrating a state where a door of the cash transaction machine of FIG. 1 is opened.

FIG. 1 is a perspective view illustrating a cash transaction machine 100 according to an exemplary embodiment of the present invention, and FIG. 2 is a perspective view illustrating a state where a door 140 of the cash transaction machine 100 is opened.

Referring to FIGS. 1 and 2, the cash transaction machine 100 includes a body 120 that includes an opening on a side of the body 120, the door 140 that opens and closes the opening, a first financial module 220 that is integrally provided formed with the door 140 in the door 140 to be externally exposed when the door 140 is opened, and a second financial module 240 that is provided in the body 120, separate from the door 140 to move toward the opening and thereby be externally exposed when the door is opened 140.

A manipulation portion 160, a dispensing portion 182, and a depositing portion 184 are formed on an external surface of the body 120. A user may enter an amount of withdrawal, a password, and the like using the manipulation portion 160. The user may withdraw or deposit bills via the dispensing portion 182 and the depositing portion 184. In the present exemplary embodiment, the first financial module 220 and the second financial module 240 may denote a dispensing module and a depositing module respectively. Corresponding thereto, the dispensing portion 182 and the depositing portion 184 are formed on the body 120. However, the present invention is not limited thereto. Therefore, the first financial module 220 and the second financial module 240 may replace the above-described other modules and be variously modified depending on embodiments.

As shown in FIG. 2, the opening is formed on the side of the body 120 to pass the first financial module 220 and the second financial module 240. The door 140 is provided on one side of the opening. The door 140 may be movably provided on the left or right side of the opening. Preferably, the door 140 may be provided adjacent to the side where the dispensing portion 182 is formed. This is because an outlet of the first financial module 220 must be positioned adjacent to the dispensing portion 182 when the door 140 is closed. Also, a lock assembly 142 may be mounted onto the door 140 to lock the door 140.

In the present exemplary embodiment, only one second financial module 240 is provided separate from the body 240. However, the present invention is not limited thereto. Specifically, at least two second financial modules may be provided in the body 120. Also, separate equipments may be installed in the first financial module 220.

The first financial module 220 is integrally formed with the door 140 on the inner surface of the door 140. When the door 140 is opened, the first financial module 220 may be externally exposed together with the door 140. Also, the second financial module 240 may be further provided in the body 120. The second financial module 240 is provided in the body 120 in parallel with the first financial module 220. The second financial module 240 may move, separate from the first financial module 220, to be externally exposed.

The second financial module 240 is provided separate from the first financial module 220. Therefore, when the first financial module 220 or the second financial module 240 needs to be repaired or replaced, it is possible to separately repair or replace the first financial module 220 and the second financial module 240. Specifically, each of the first financial module 220 and the second financial module 240 may be independently exposed to the outside. Therefore, depending on the necessity of an operator, it is possible to externally expose, and repair or replace each of the first financial module 220 and the second financial module 240. Each of the first financial module 220 and the second financial module 240 may be formed as a module capable of providing various types of financial services, such as a bill depositing/dispensing portion, a card reader, and the like. The present invention is not limited to or restricted by the type of the financial module that is provided in the body 120.

A guide member 260 may be provided to enable the second financial module 240 to move separately from the first financial module 220 as described above. The guide member 260 may function to guide the second financial module 240 to move between an internal mounting location and an opening location. For this, the guide member 260 includes a guide rail 262 and a guide coupling portion 264. The guide coupling portion 264 is formed on a top surface of the second financial module 240. The guide rail 262 is formed in an inner ceiling 132 of the body 120 and restricts a travel route of the second financial module 240 using the guide coupling portion 264. Hereinafter, the guide member 260 will be described with reference to FIGS. 3 and 4.

Figure 3:
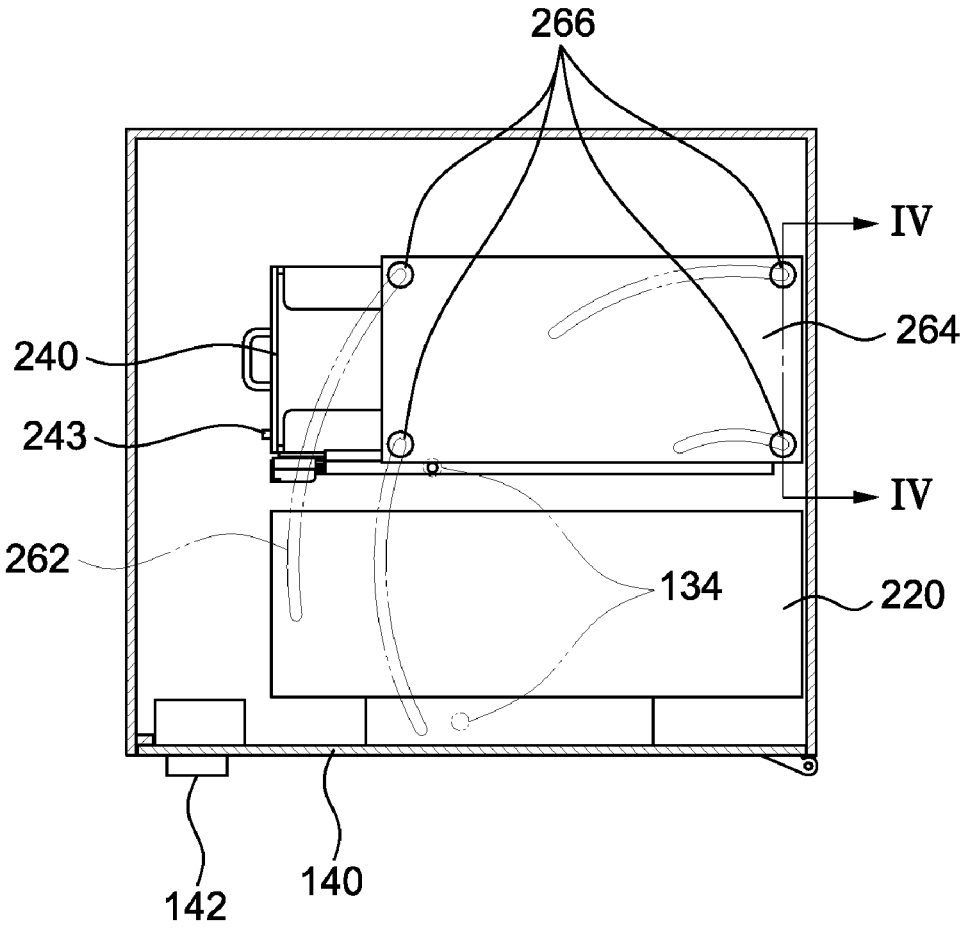
FIG. 3 is a top view illustrating the displacement of a first financial module and a second financial module in the cash transaction machine of FIG. 1.
Figure 4:
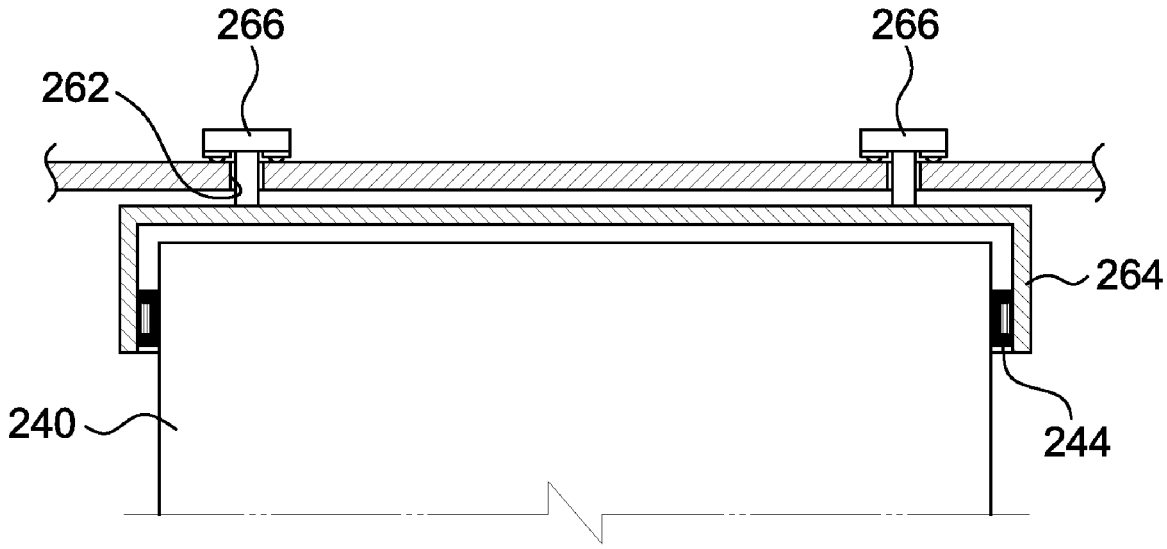
FIG. 4 is a cross-sectional view for describing a portion IV-IV of FIG. 3.

FIG. 3 is a top view illustrating the displacement of the first financial module 220 and the second financial module 240 in the cash transaction machine 100 of FIG. 1, and FIG. 4 is a cross-sectional view for describing a portion IV-IV of FIG. 3.

Referring to FIGS. 3 and 4, the first financial module 220 and the second financial module 240 are provided in parallel. When the second financial module 240 is positioned in a location enabling performance of operations in the body 120, the location may be referred to as "an inner mounting location". Also, when the second financial module 240 moves to the opening and thereby is positioned in a location for maintenance and repair, the location may be referred to as "an opening location".

As described above, the guide member 260 may be provided to externally move the second financial module 240 from the body 120. The guide member 260 includes the guide rail 262 and the guide coupling portion 264. In the present exemplary embodiment, the guide rail 262 consists of four slits that are formed on the inner ceiling 132 of the body 120. The four slits are formed in correspondence to protrusions 266 that are formed in the guide coupling portion 264. The guide coupling portion 264 receives a top portion of the second financial module 240. The second financial module 240 may be slidably connected to the guide coupling portion 264 via a rail 244. Also, in the present exemplary embodiment, the guide member 260 is formed on the ceiling of the body 120. However, the present invention is not limited thereto. Specifically, the guide member 260 may be formed on an inner floor of the body 120, or on the ceiling and the floor of the body 120. Also, the guide coupling portion 264 may be formed on the inner floor of the body 120, or on the inner ceiling 132 and the inner floor of the body 120.

The guide rail 262 is coupled with the protrusion 266. The guide rail 262 may guide the movement of the second financial module 240 while the second financial module 240 moves from the inner mounting location to the opening location. More specifically, the slit-shaped guide rail 262 may be formed in a curved shape. The guide rails 262 may be formed in the same shape or in different shapes in correspondence to the travel route of the second financial module 240. In the present exemplary embodiment, the guide rail 262 is formed in the slit shape. However, the guide rail 262 may be provided on the inner ceiling of the body 120 as a separate rail member.

The guide coupling portion 264 may include the protrusion 266 to physically couple with the guide rail 262. The protrusion 266 may be formed to be larger than the slit-width of the guide rail 262. For smooth movement, lubricating oil, a bearing, and the like may be disposed between the guide rail 262 and the protrusion 266. Also, the structure of the protrusion 266 and the guide rail 262 may be variously modified based on the required condition, the design specification, and the like.

Figure 5:
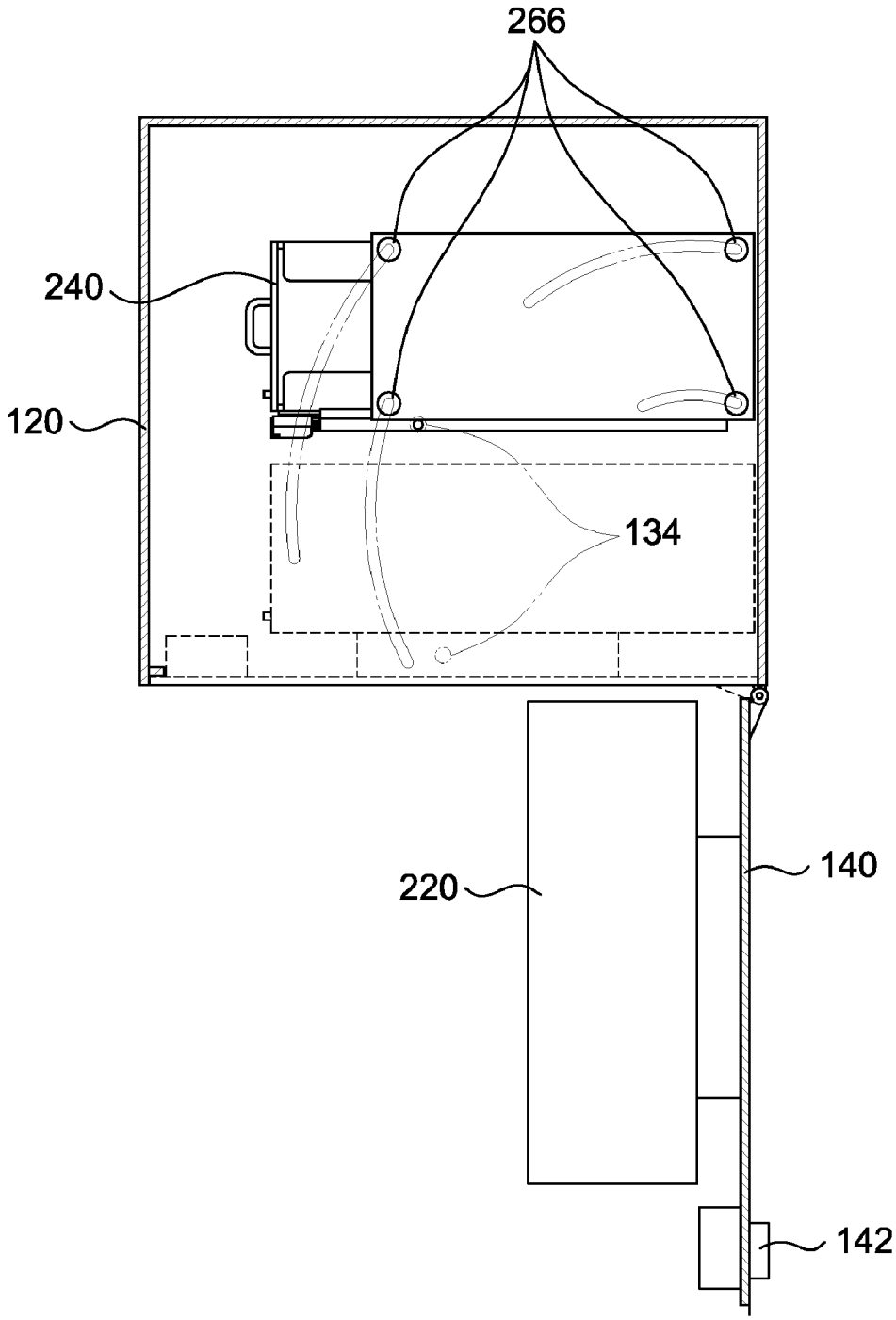
FIGS. 5 through 7 are top views for describing the movement mechanism of the first financial module and the second financial module of FIG. 3.
Figure 6:
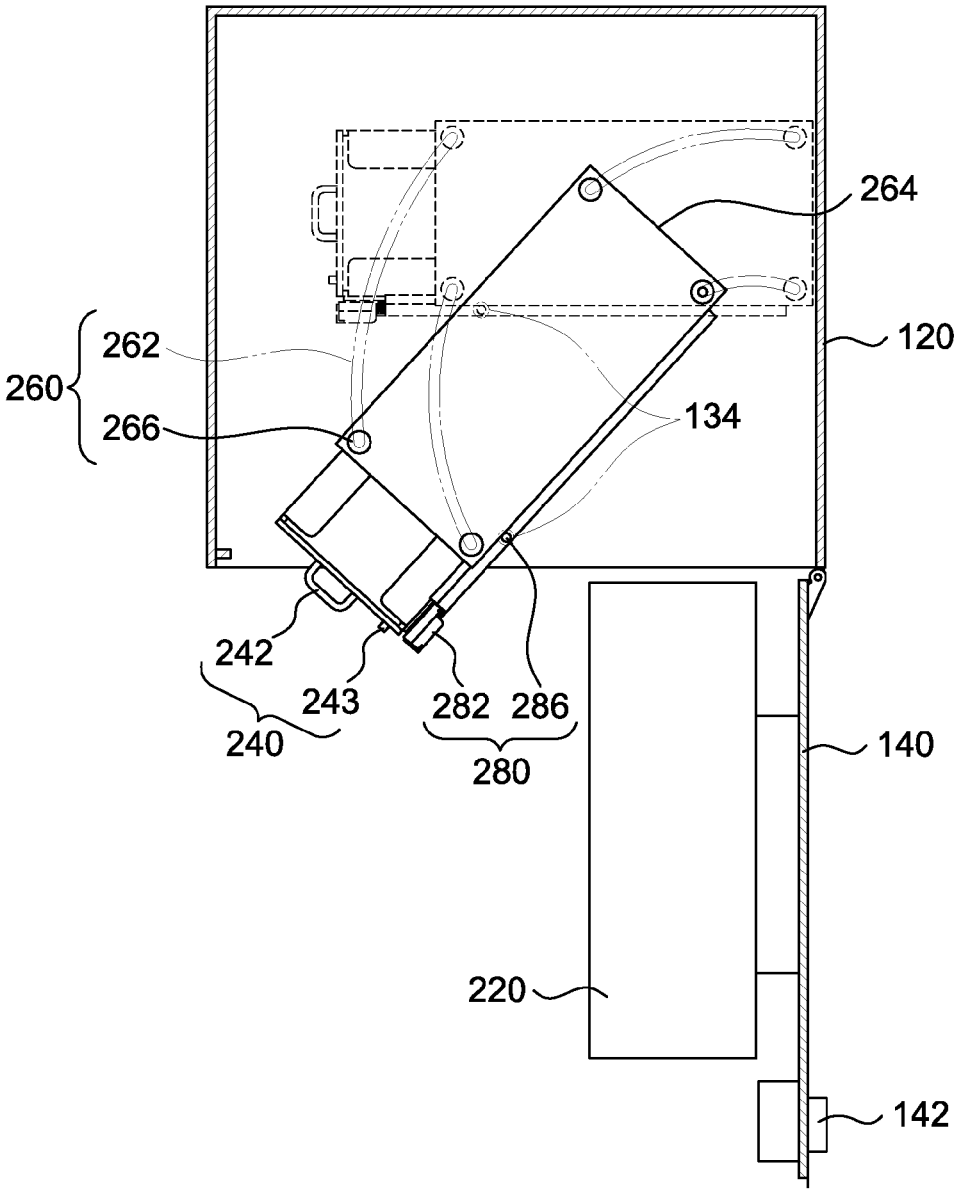
Figure 7:
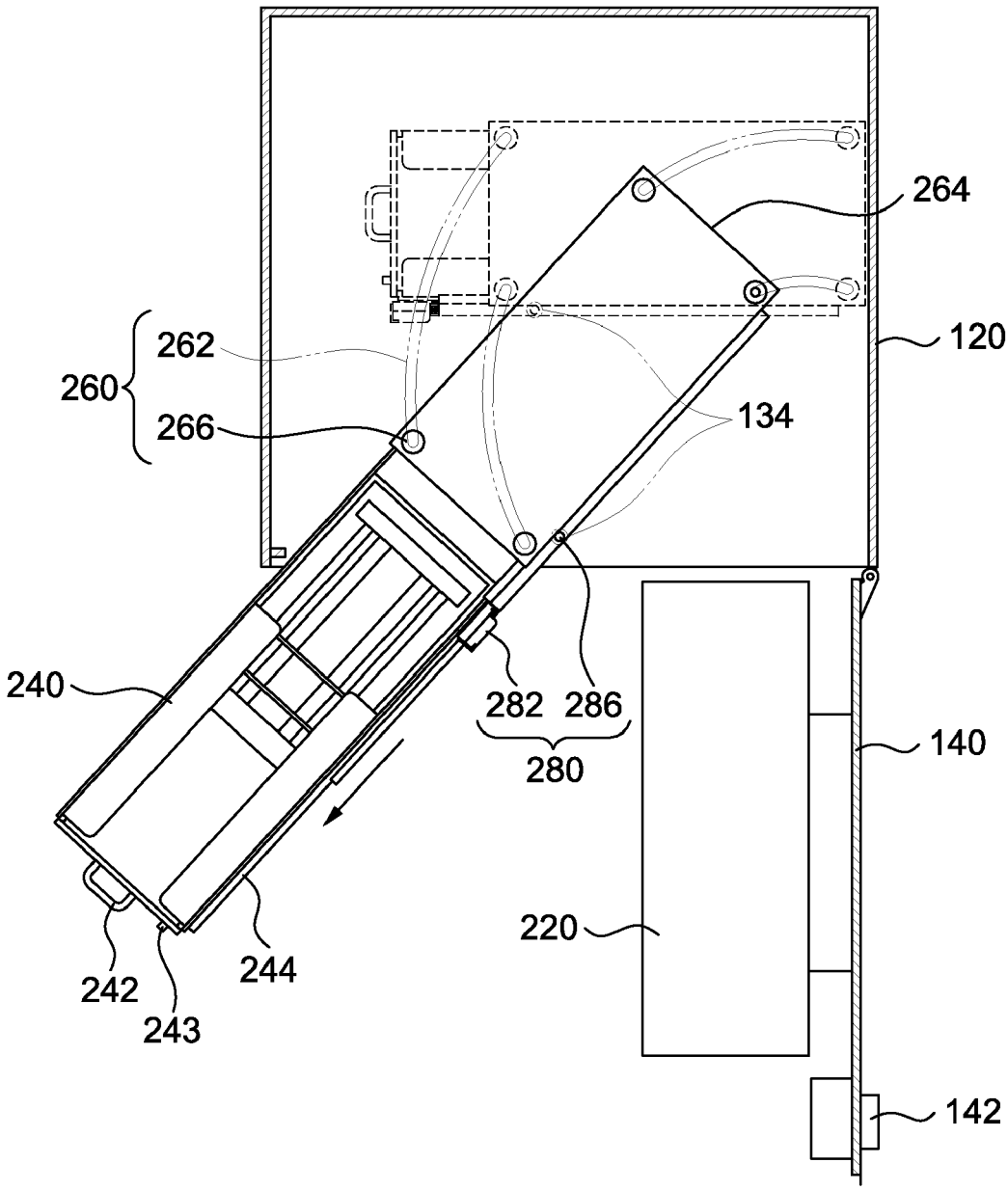

FIGS. 5 through 7 are top views for describing the movement mechanism of the first financial module 220 and the second financial module 240 of FIG. 3.

Referring to FIG. 5, the door 140 may be opened for the management of the first financial module 220 and the second financial module 240, or other purposes. In this instance, the first financial module 220 is integrally formed with the door 140 and thus may be externally exposed along with the door 140 when the door 140 is opened. The second financial module 240 is movably provided in the body 120, separate from the first financial module 220. Since the second financial module 240 is not provided with the door 140, it is possible to maintain a small width of the door 140.

Referring to FIGS. 6 and 7, the operator may move the second financial module 240 to the outside. The operator may initially move the second financial module 240 to the opening location adjacent to the opening and subsequently slide the second financial module 240 from the guide coupling portion 264 to be additionally exposed.

The second financial module 240 is fixed to a temporary fixing member 280 in the inner mounting location. In order to move the second financial module 240 to the opening location, the operator may temporarily release the temporary fixing member 280 and then move the guide coupling portion 264 and the second financial module 240 to the outside. The temporary fixing member 280 will be described in detail with reference to FIGS. 8 and 9.

As shown in FIG. 6, the operator may grab a knob 242 formed on the second financial module 240 and externally move the second financial module 240. In this instance, each protrusion 266 of the guide coupling portion 264 moves along each guide rail 262 and may change the location and the posture of the second financial module 240. In the present exemplary embodiment, the guide rails 262 are formed in the curved shape and thus may guide the location of the second financial module 240 and also turn the posture of the second financial module 240 to about 60 degrees. For the change of the posture, the guide rails 262 are formed in different shapes.

Also, in the cash transaction machine 100 that includes the door 140 on the side of the body 120, an inner space is restricted. Therefore, the curved motion may be more desirable than the linear motion in order to move the second financial module 240 in the restricted inner space.

The guide rail 262 may be formed in a region where the second financial module 240 may be externally exposed. Depending on the number of protrusions 266 formed on the guide coupling portion 264, the length and the shape of the guide rail 262 may be determined.

As shown in FIG. 7, the operator may pull the knob 242 and thereby additionally move the second financial module 240 after pushing a release button 243 next to the knob 242. In this case, the second financial module 240 moves toward an inclined direction, separate from the first financial module 220. Therefore, it is possible to repair and maintain the second financial module 240, separate from the first financial module 220. The second financial module 240 may be designed to face various directions from the opening location. Desirably, the second financial module 240 may be designed to face an opposite direction to the hinge of the door 140.

For smooth sliding between the second financial module 240 and the guide coupling portion 264, the second financial module 240 and the guide coupling portion 264 may be connected to each other using a rail, and the like. For example, the rail 244 moving in multi-steps may be used.

The second financial module 240 may be pushed back into the body 120 to be below the guide coupling portion 264. Specifically, the second financial module 240 may move from the opening location to the inner mounting location together with the guide coupling portion 264. In this instance, the temporary fixing member 280 may be used to relatively fix the guide coupling portion 264 with respect to the body 120. Also, the guide coupling portion 264 may be released from the body 120 using the temporary fixing member 280.

Figure 8:
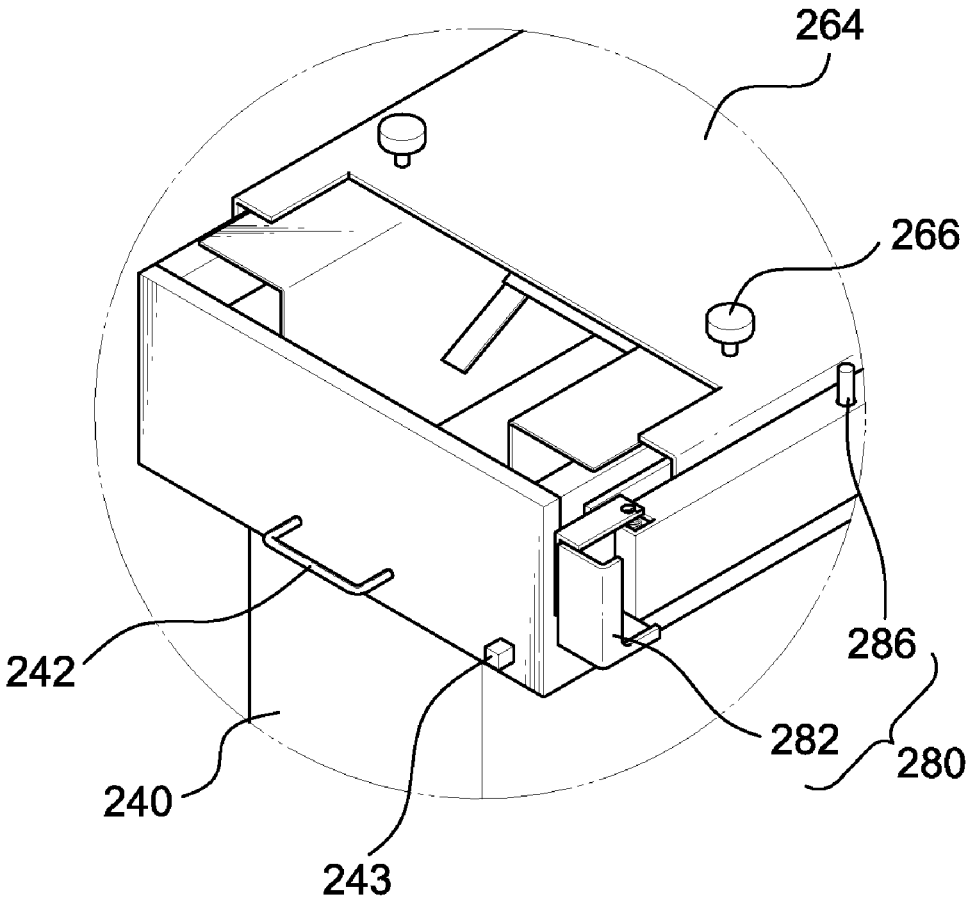
FIG. 8 is a partially enlarged perspective view for describing a temporary fixing member of FIG. 6.
Figure 9A:
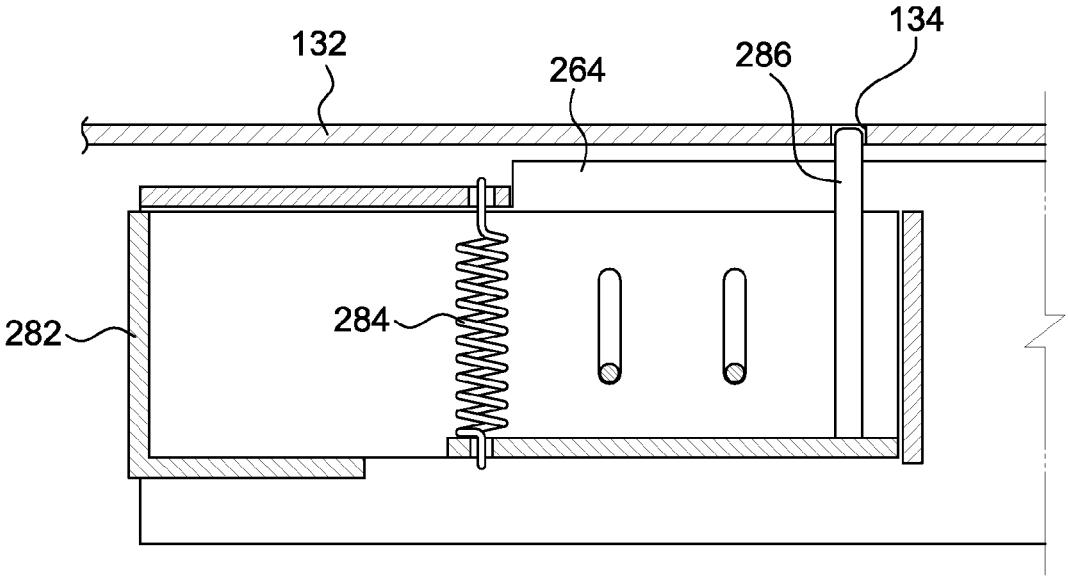
FIGS. 9A and 9B are cross-sectional views for describing the operating mechanism of the temporary fixing member of FIG. 8.
Figure 9B:
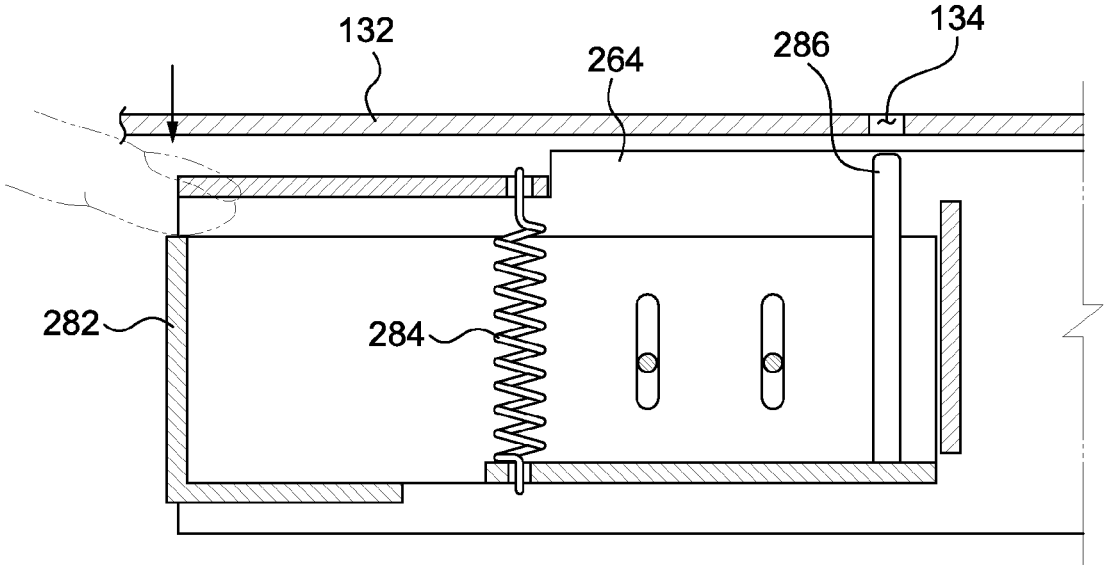

FIG. 8 is a partially enlarged perspective view for describing the temporary fixing member 280 of FIG. 6, and FIGS. 9A and 9B are cross-sectional views for describing the operating mechanism of the temporary fixing member 280 of FIG. 8.

Referring to FIGS. 8, 9A and 9B, the temporary fixing member 280 includes an operating bracket 282 and a fixing pin 286. A fixing hole 134 may be formed in the inner ceiling 132 of the body 120 in correspondence to the fixing pin 286. The temporary fixing member 280 is used to temporarily fix the second financial module 240 in the inner mounting location and the opening location. Specifically, the temporary fixing member 280 may enable the second financial module 240 to stably perform operations in the inner mounting location. Also, the temporary fixing member 280 may prevent the second financial module 240 from unintentionally moving toward the inside in the opening location.

The operating bracket 282 is provided on the side of the guide coupling portion 264 to be upwardly and downwardly movable with respect to the second financial module 240. The fixing pin 286 is vertically provided on one side of the operating bracket 282 to be upwardly and downwardly movable with the operating bracket 282. Also, the operating bracket 282 is connected to one end of a spring 284. The guide coupling portion 264 is connected to another end of the spring 284. Therefore, the operating bracket 282 may elastically move.

As shown in FIGS. 3 and 6, the fixing hole 134 may be formed in the inner ceiling 132 of the body 120 in correspondence to the fixing pin 286 of the temporary fixing member 280. The fixing hole 134 may be respectively formed corresponding to when the second financial module 240 is positioned in the inner mounting location as shown in FIG. 3, and when the second financial module is positioned in the opening location as shown in FIG. 6.

Referring to FIG. 9A, when no external force is given, the operating bracket 282 is elastically pulled by the spring 284 and the fixing pin 286 is positioned in a location coupled with the inner ceiling 132. Referring to FIG. 9B, when the operator pushes the operating bracket 282 to temporarily move, the fixing pin 286 may be separated from the fixing hole 134. The operator may move the second financial module 240 from the inner mounting location to the opening location, or conversely from the opening location to the inner mounting location.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A cash transaction machine comprising:

a body including an opening on a side of the body;

a door being mounted on the body to open and close the opening;

a first financial module being integrally formed with the door to be externally exposed when the door is opened;

a second financial module being provided in the body, separate from the door to move toward the opening when the door is opened; and a guide member guiding movement of the second financial module, wherein the guide member comprises a guide coupling portion that is formed on a top surface or a bottom surface of the second financial module, and a guide rail that is formed on an inner ceiling or an inner floor of the body in correspondence to the guide coupling portion, and restricts a travel route of the second financial module using the guide coupling portion, and wherein the travel route is curved and the guide rail guides the second financial module along the curved travel route that is formed from an inner mounting location to an opening location.

2. The cash transaction machine of claim 1, wherein the guide rail comprises a plurality of slits that is formed on the inner ceiling or the inner floor of the body, and the guide coupling portion comprises a plurality of coupling protrusions that is coupled with the plurality of slits respectively.

3. The cash transaction machine of claim 1, wherein the second financial module is slidably provided to the guide coupling portion and the second financial module is additionally slidable with respect to the guide coupling portion after moving to the opening.

4. The cash transaction machine of claim 1, further comprising:

a temporary fixing member temporarily fixing the second financial module in an inner mounting location of the second financial module and an opening location.

5. The cash transaction machine of claim 4, wherein the temporary fixing member comprises a bracket that is upwardly and downwardly movable with respect to the second financial module and a fixing pin that interoperates with the bracket, and a fixing hole is formed in the inner ceiling or the inner floor of the body in correspondence to the fixing pin, and the fixing pin is formed in correspondence to the inner mounting location of the second financial module or the opening location.

6. A cash transaction machine comprising:

a body including an opening on a side of the body;

a door being mounted on the body to open and close the opening;

a first financial module being integrally formed with the door to be externally exposed when the door is opened;

a guide member comprising a guide rail that is formed on an inner ceiling or an inner floor of the body and provides a curved travel route from an inner mounting location to an opening location, and a guide coupling portion that is coupled with the guide rail and moves between the inner mounting location and the opening location; and a second financial module being slidably provided to the guide coupling portion to move between the inner mounting location and the opening location together with the guide coupling portion.

7. The cash transaction machine of claim 6, wherein the guide rail comprises a plurality of slits that is formed on the inner ceiling or the inner floor of the body, and the guide coupling portion comprises a plurality of coupling protrusions that is coupled with the plurality of slits respectively.

8. The cash transaction machine of claim 6, further comprising:

a temporary fixing member temporarily fixing the second financial module in the inner mounting location of the second financial module and the opening location.

9. The cash transaction machine of claim 8, wherein the temporary fixing member comprises a bracket that is upwardly and downwardly movable above the second financial module and a fixing pin that interoperates with the bracket, and a fixing hole is formed in the inner ceiling or the inner floor of the body in correspondence to the fixing pin, and the fixing pin is formed in correspondence to the inner mounting location of the second financial module or the opening location.

* * * * *